US006830666B2

(12) United States Patent
Moore

(10) Patent No.: US 6,830,666 B2
(45) Date of Patent: Dec. 14, 2004

(54) ELECTROPLATING APPARATUS AND METHOD

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 472 days.

(21) Appl. No.: 09/813,164

(22) Filed: Mar. 21, 2001

(65) Prior Publication Data

US 2001/0009226 A1 Jul. 26, 2001

Related U.S. Application Data

(63) Continuation of application No. 09/385,381, filed on Aug. 30, 1999, now Pat. No. 6,217,727.

(51) Int. Cl.[7] ..... C25D 17/00

(52) U.S. Cl. ..... 204/225; 204/224 R; 204/229.8

(58) Field of Search ..... 205/123, 157, 205/68, 70, 222, 224 R, 225, 229.8; 204/222, 224 R, 225, 229.8; 25/70

(56) References Cited

U.S. PATENT DOCUMENTS

| | | | | |
|---|---|---|---|---|
| 3,186,932 A | * | 6/1965 | Gelfand et al. | 204/216 |
| 3,746,633 A | | 7/1973 | Miyato et al. | |
| 3,880,725 A | * | 4/1975 | Van Raalte et al. | 205/95 |
| 3,887,452 A | | 6/1975 | Mannaka et al. | |
| 4,098,666 A | | 7/1978 | Ralston | |
| 4,187,154 A | * | 2/1980 | Dewallens | 205/68 |
| 4,269,669 A | * | 5/1981 | Soby et al. | 205/50 |
| 4,287,043 A | | 9/1981 | Eckert et al. | |
| 4,497,695 A | | 2/1985 | Shinkai et al. | |
| 4,539,079 A | * | 9/1985 | Okabayashi | 205/68 |
| 5,344,491 A | * | 9/1994 | Katou | 118/695 |
| 5,421,987 A | | 6/1995 | Tzanavaras et al. | |
| 5,472,592 A | | 12/1995 | Lowery | |
| 5,670,034 A | | 9/1997 | Lowery | |
| 5,833,820 A | | 11/1998 | Dubin | |
| 6,074,544 A | * | 6/2000 | Reid et al. | 205/157 |
| 6,174,425 B1 | * | 1/2001 | Simpson et al. | 205/96 |
| 6,217,727 B1 | * | 4/2001 | Moore | 204/225 |
| 6,261,433 B1 | * | 7/2001 | Landau | 205/96 |
| 6,344,126 B1 | * | 2/2002 | Moore | 25/123 |

OTHER PUBLICATIONS

F. A. Lowenheim, Electroplating, McGraw–Hill Book Co., New York, 1978, pp. 139.*

* cited by examiner

*Primary Examiner*—Roy King
*Assistant Examiner*—W. T. Leader
(74) *Attorney, Agent, or Firm*—Dickstein Shapiro Morin & Oshinsky LLP

(57) ABSTRACT

An electroplating apparatus is provided with a metal target and a device for supporting a semiconductor wafer (or other workpiece) in an electroplating solution. The target (anode) may be located relatively far from the wafer surface (cathode) at the beginning of the plating process, until a sufficient amount of metal is plated. When an initial amount of metal is built up on the wafer surface, the target may be moved closer to the wafer for faster processing. The movement of the target may be controlled automatically according to one or more process parameters.

7 Claims, 2 Drawing Sheets

ELECTROPLATING APPARATUS AND METHOD

This is a continuation of U.S. patent application Ser. No. 09/385,381, filed Aug. 30, 1999 now U.S. Pat. No. 6,217, 727, the entire disclosure of which is incorporated herein by reference.

FIELD OF THE INVENTION

The present invention relates to a system for electroplating the surfaces of semiconductor wafers and other workpieces. More particularly, the present invention relates to an electroplating apparatus and method that achieves improved performance with respect to thickness uniformity and rate of metal deposition.

BACKGROUND OF THE INVENTION

It is known to electroplate the surfaces of semiconductor wafers. It has been difficult, however, to obtain an electroplated layer of uniform thickness. It has been especially difficult to achieve the desired thickness uniformity at a high rate of metal deposition. Known systems for electroplating semiconductor products are described in U.S. Pat. No. 5,833,820 (Dubin), U.S. Pat. No. 5,670,034 (Lowery), U.S. Pat. No. 5,472,592 (Lowery), and U.S. Pat. No. 5,421,987 (Tzanavaras).

SUMMARY OF THE INVENTION

The present invention relates to an apparatus for electroplating a semiconductor product. The apparatus includes a support device for supporting the product in an electroplating solution, an electrical circuit for applying an electrical potential across the electroplating solution, and a control device for reducing the current distance to the product through the solution after an initial amount of conductive material is electroplated on the product surface. The semiconductor product may be, for example, a semiconductor wafer or chip. Integrated circuits may be formed in the product if desired.

According to one aspect of the invention, the support device includes conductive contacts. The contacts may be used to connect the product to the electrical circuit.

According to another aspect of the invention, the control device includes a mechanism for moving a metal target (anode) toward the electroplated product. In an alternative embodiment of the invention, the product may be moved toward the anode.

According to another aspect of the invention, a processor is used to operate the control device in response to data correlated to the electroplating process. The input data may be functionally related or correlated to elapsed electroplating time, the resistance of the product in the electroplating solution, the optical characteristics of the product, the surface capacitance of the product, etc.

The present invention also relates to a method of electroplating the surface of a semiconductor wafer. The method includes the steps of using an electrode to electroplate an initial amount of conductive material on the wafer surface, then changing the distance between the electrode and the wafer surface, and then using the electrode to electroplate an additional amount of material on the wafer surface. According to a preferred embodiment of the invention, at the start of the process, while the resistance of the wafer is significant, thickness uniformity is promoted by locating the target far from the wafer. Then, when the wafer resistance is reduced by the initial amount of electrodeposited metal, higher plating efficiency may be obtained by moving the target closer to the wafer.

According to another aspect of the invention, the wafer may be provided with a refractory seed layer. The seed layer contains metal and adheres to the semiconductor wafer material. The resistance of the seed layer is greater than that of the electrodeposited metal.

Thus, according to a preferred embodiment of the invention, a metal target (anode) is located relatively far from the wafer (cathode) at the beginning of the plating process, until a sufficient amount of metal is plated on the wafer surface. Once the metal is built up on the wafer surface, the target is moved closer to the wafer for faster processing.

As explained in more detail below, before the metal is built up on the wafer surface, the high resistance of the seed layer is a significant factor. The electrical potential near the contacts on the edges of the wafer is greater than the potential at the center of the wafer. Consequently, according to the invention, the target and the wafer are separated from each other to increase the resistance of the electroplating solution (the bath). A relatively high bath resistance mutes the significance of the potential difference in the radial direction of the wafer. Metal built up on the wafer surface has less resistance than the seed layer, such that the difference in potential across the surface of the wafer becomes less significant. Eventually, the target can be moved closer to the wafer (to reduce the bath resistance and increase the deposition rate) without impairing plating uniformity.

These and other features and advantages of the invention will become apparent from the following detailed description of preferred embodiments of the invention.

DETAILED DESCRIPTION OF PREFERRED EMBODIMENTS

Figure 1:
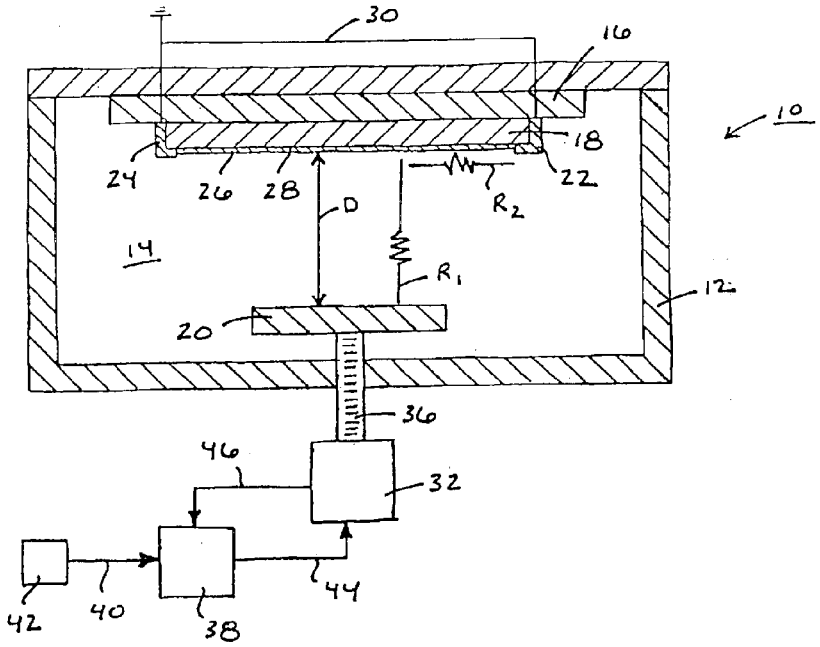
FIG. 1 is a cross-sectional view of an electroplating apparatus constructed in accordance with a preferred embodiment of the present invention.

Referring now to the drawings, where like reference numerals designate like elements, there is shown in FIG. 1 an electroplating apparatus 10 constructed in accordance with a preferred embodiment of the present invention. The apparatus 10 has a tank 12 containing electroplating solution 14, a wafer support 16 for supporting a wafer 18 in the solution 14, and a metal target (anode) 20. The wafer support 16 may have metal clips 22, 24 for holding the wafer 18 in the desired position. An electrically conductive seed layer 26 may be formed on the wafer surface 28. The seed layer 26 may be electrically grounded through the clips 22, 24 and suitable wires 30.

In operation, voltage is applied to the target 20 by a control device 32. The electrical potential causes current to flow from the target 20, through the solution 14, through the seed layer 26, and through the clips 22, 24 to the grounding wires 30. The electroplating process causes a metal layer 34 (FIG. 2) to form on the seed layer 26. The process may be continued until the metal layer 34 achieves the desired thickness. The electroplated wafer 18 may then be removed from the tank 12 for further processing.

The rate at which metal 34 is deposited on the wafer surface 28 is proportional to the combined resistance of the solution 14 and the seed layer 26, as follows:

$$I=A/(R_1+R_2),$$

where I is the metal deposition rate, A is a constant, $R_1$ is the resistance of the solution 14, and $R_2$ is the resistance of the wafer 18. The solution resistance $R_1$ depends on (1) the distance D between the target 20 and the wafer surface 28 and (2) the conductivity of the solution 14. For any particular point on the wafer surface 28, the wafer resistance $R_2$ depends on (1) the distance from that point to the electrical contacts 22, 24 and (2) the conductivity of the wafer 18.

At the start of the electroplating process (that is, before any metal 34 is formed on the seed layer 26), the wafer resistance $R_2$ is a significant factor with respect to the deposition rate I. The resistance of the seed layer 26 may be substantial. Consequently, at the start of the process, the value of $R_2$ may vary substantially as a function of radial position on the wafer 18. That is, the value of $R_2$ would tend to increase as distance increases from the clips 22, 24. To mute the significance of the wafer resistance $R_2$ and to thereby improve the thickness uniformity of the initially deposited metal 34, the target 20 initially may be located relatively far from the wafer 18 (FIG. 1). As the conductive metal 34 is formed on the seed layer 26, the wafer resistance $R_2$ becomes much less significant relative to the solution resistance $R_1$. After the initial amount of metal 34 is formed on the wafer 18, the target may be moved closer to the wafer 18 to reduce the solution resistance $R_1$ and to increase the deposition rate I.

Figure 3:
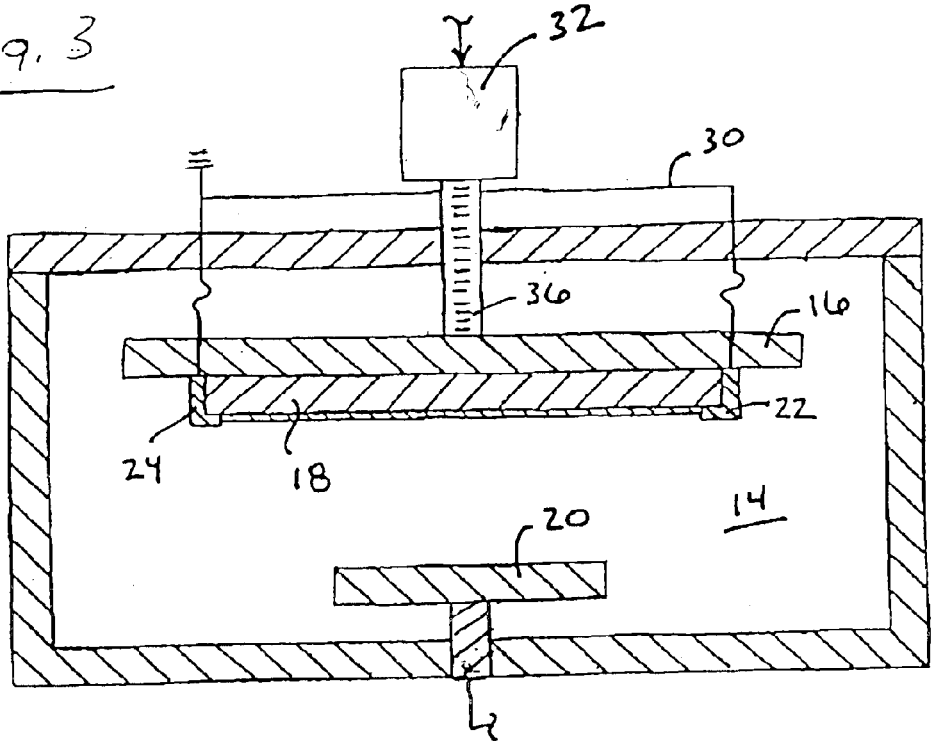
FIG. 3 is a cross-sectional view of an electroplating apparatus constructed in accordance with another preferred embodiment of the present invention.

The target 20 may be moved by a suitable mechanism 36 controlled by the control device 32. In an alternative embodiment of the invention, shown in FIG. 3, the wafer 18 may be moved closer to the target 20. In another alternative embodiment, (not shown) more than one anode may be employed—one relatively far-away from the wafer 18 to form the initial amount of metal on the wafer 18 and the other located relatively close to the wafer 18 to form the rest of the metal layer 34 at a relatively high deposition rate.

The control device 32 (FIG. 2) may be operated by a suitable microprocessor 38 or the like. Signals 40 may be input to the processor 38 representative of elapsed electroplating time, the measured resistance of the wafer 18, die optical characteristics (e.g., reflectivity) of the wafer 18, and/or the surface capacitance of the wafer 18. The input signals 40 may be generated by a suitable input device 42, such as a clock or a suitable measuring device. The resistance of the wafer 18 may be determined by measuring the voltage between the contacts 22, 24. The bulk resistance of the wafer 18 also may be determined off-line, for example, by a four-point probe device (not shown).

The processor 38 may have a look-up table and/or an algorithm that correlates elapsed electroplating time to metal thickness and/or deposition rate for known solutions 14 and target positions. Feedback signals 46 representative of the position of the target 20 (and/or the distance D between the target 20 and the wafer 18) may be provided to the processor 38 by the controller 32. The processor 38 may be programmed to send operating signals 44 to the controller 32 to automatically move the target 20 closer to the wafer 18 when a predetermined amount of metal 34 is formed on the seed layer 26.

The motion of the target 20 toward the wafer 18 may be continuous or gradual, and, the motion may be programmed to optimize plating efficiency while achieving the desired uniformity. In an alternative embodiment of the invention, the target 20 may be moved in a stepwise fashion toward the wafer 18 at a predetermined time in the process or when a predetermined amount of metal 34 is determined to have been formed on the wafer 18.

Figure 2:
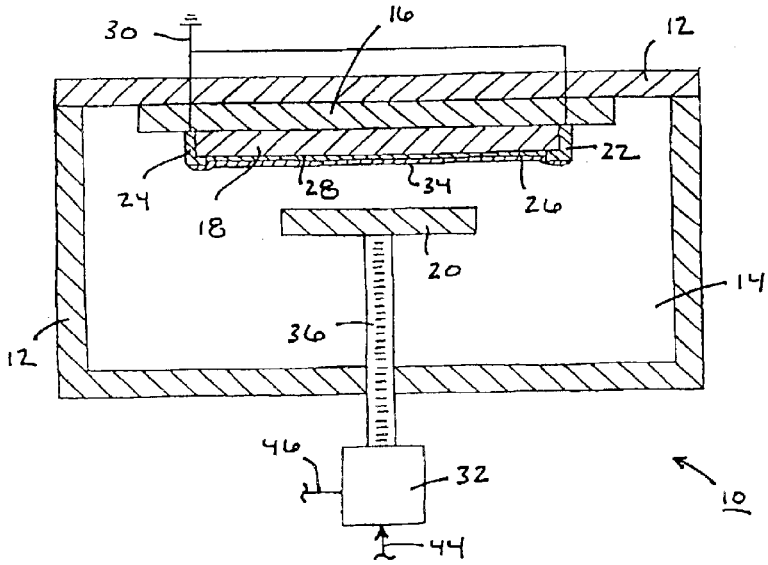
FIG. 2 is another cross-sectional view of the electroplating apparatus of FIG. 1, showing the apparatus at a subsequent stage of operation.

In a preferred embodiment of the invention, the target 20 may be located about five centimeters from the wafer surface 28 in the start position (FIG. 1), and about one to two centimeters in the high efficiency plating position (FIG. 2). The present invention should not be limited, however, to the preferred embodiments described and illustrated in detail herein.

The solution 14 may be arranged to deposit copper, platinum, gold or another suitable material on the wafer 18. The seed layer 26 may be formed by a known chemical vapor deposition (CVD) process. The seed layer 26 may be, for example, a refractory and metal composite material that adheres to the wafer surface 28. The metal component of the seed layer 26 may be the same as or different than the plated metal material 34.

If desired, the tank 12 may be provided with a cascade structure (not shown) to ensure that fresh solution 14 is made available to the wafer (cathode) 18. Other suitable means, such as a diffuser or baffle plate, for agitating and flowing the solution 14 against the wafer 18 may be employed, if desired. Although the tank 12 is shown with only one support device 16, the invention may be employed with more than one support device 16 per tank 12. If desired, a number of wafers 18 may be electroplated in the same solution 14 simultaneously. Suitable electrodes 20, 22, 24 may be provided for each wafer 18.

The above descriptions and drawings are only illustrative of preferred embodiments which achieve the features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. An apparatus for electroplating a semiconductor product, comprising:

a reservoir configured to contain an electroplating solution;

a support associated with the reservoir and configured to hold a substrate such that when the reservoir is filled with solution and a substrate is held on the support, the substrate is in contact with solution contained in the reservoir; and an electrode configured such that when the reservoir is filled with electroplating solution, the electrode also contacts the solution; and wherein the distance between the electrode and the support is changeable between a first operating distance and a second operating distance such that when the reservoir is filled with solution, both the electrode and a substrate held on the support maintain contact with the solution through any change in distance between the first operating distance and the second operating distance; and wherein the support includes conductive contacts for holding a substrate thereto.

2. The apparatus according to claim 1, wherein the electrode is movable relative to the support to thereby change the distance between the electrode and the support.

3. The apparatus according to claim 1, wherein the support is movable relative to the electrode to thereby change the distance between the electrode and the support.

4. The apparatus according to claim 1, wherein the reservoir is formed as a cascade-type structure.

5. The apparatus according to claim 1, further comprising a device for agitating solution contained in the reservoir.

6. The apparatus according to claim 5, wherein the device for agitating comprises a diffuser.

7. The apparatus according to claim 5, wherein the device for agitating comprises a baffle plate.

* * * * *

UNITED STATES PATENT AND TRADEMARK OFFICE

CERTIFICATE OF CORRECTION

PATENT NO. : 6,830,666 B2
DATED : December 14, 2004
INVENTOR(S) : Scott E. Moore It is certified that error appears in the above-identified patent and that said Letters Patent is hereby corrected as shown below:

Column 3,
Line 48, reads "of the wafer 18, die" should read -- of the wafer 18, the --.

Signed and Sealed this

Thirteenth Day of September, 2005

JON W. DUDAS
*Director of the United States Patent and Trademark Office*